US008037701B2

(12) United States Patent
Anell et al.

(10) Patent No.: US 8,037,701 B2
(45) Date of Patent: Oct. 18, 2011

(54) CONTROL FOR A REFRIGERATOR

(75) Inventors: Thomas Carl Anell, Knoxville, IA (US); Nelson J. Ferragut, II, Williamsburg, IA (US); Carl J. Franken, Davenport, IA (US); Alvin V. Miller, Swisher, IA (US); Mauro M. Oliveira, Cedar Rapids, IA (US); Todd E. Pritts, Cedar Rapids, IA (US); Alan G. Tarrant, Williamsburg, IA (US); Robert L. Wetekamp, Cedar Rapids, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 12/820,173

(22) Filed: Jun. 22, 2010

(65) Prior Publication Data

US 2010/0257876 A1 Oct. 14, 2010

Related U.S. Application Data

(62) Division of application No. 11/327,342, filed on Jan. 9, 2006, now Pat. No. 7,765,819.

(51) Int. Cl.
*F25D 17/04* (2006.01)
*F25D 17/06* (2006.01)
*F25D 11/02* (2006.01)

(52) U.S. Cl. ..... 62/187; 62/186; 62/441

(58) Field of Classification Search ..... 62/187, 62/186, 407, 411, 419, 404, 441
See application file for complete search history.

(56) References Cited

U.S. PATENT DOCUMENTS

| | | | | |
|---|---|---|---|---|
| 5,325,522 | A * | 6/1994 | Vaughn | 1/1 |
| 5,996,361 | A * | 12/1999 | Bessler et al. | 62/163 |
| 6,343,477 | B1 * | 2/2002 | Mandel et al. | 62/187 |
| 6,532,751 | B1 * | 3/2003 | Schenk et al. | 62/66 |
| 6,658,869 | B1 * | 12/2003 | Thornbrough | 62/137 |
| 6,679,073 | B1 * | 1/2004 | Hu | 62/135 |
| 6,769,265 | B1 * | 8/2004 | Davis et al. | 62/228.4 |
| 6,957,549 | B2 * | 10/2005 | Kim et al. | 62/408 |
| 7,032,408 | B2 * | 4/2006 | Dentella et al. | 62/441 |
| 7,131,284 | B2 * | 11/2006 | Cushman et al. | 62/187 |
| 7,222,497 | B2 * | 5/2007 | An et al. | 62/353 |
| 2003/0029178 | A1 * | 2/2003 | Zentner et al. | 62/186 |
| 2004/0187503 | A1 * | 9/2004 | Davis et al. | 62/180 |
| 2004/0231339 | A1 * | 11/2004 | Miozza et al. | 62/3.2 |
| 2005/0076654 | A1 * | 4/2005 | Chung | 62/66 |
| 2006/0006999 | A1 * | 1/2006 | Walczyk et al. | 340/539.27 |
| 2007/0130965 | A1 * | 6/2007 | Boarman et al. | 62/135 |

FOREIGN PATENT DOCUMENTS

JP 2002031464 A * 1/2002

* cited by examiner

*Primary Examiner* — Chen-Wen Jiang
(74) *Attorney, Agent, or Firm* — John W. Morrison; Kirk W. Goodwin; Diederiks & Whitelaw, PLC

(57) ABSTRACT

A refrigerator includes a fresh food compartment, a freezer compartment and a refrigeration system. A duct, exposed to the freezer compartment, leads into the fresh food compartment. A damper is arranged within the duct to selectively allow the passage of cooling air into the fresh food compartment. The refrigerator also includes an air mixing fan arranged in the fresh food compartment, a freezer mounted ice maker, a user interface having a plurality of control elements and a controller operatively associated with the user interface. The controller includes a memory having stored therein a plurality of operating parameters for controlling various aspects or features of the refrigerator, including a temperature control mode, a super cool mode, a food saver mode and a quick ice mode, which can be synergistically combined to efficiently operate the refrigerator.

11 Claims, 7 Drawing Sheets

CONTROL FOR A REFRIGERATOR

CROSS-REFERENCE TO RELATED APPLICATIONS

The present application represents a divisional of U.S. patent application Ser. No. 11/327,342 entitled "Control for a Refrigerator" filed Jan. 9, 2006, pending.

BACKGROUND OF THE INVENTION

1. Field of the Invention

The present invention pertains to the art of refrigerators and, more particularly, to a control for a refrigerator that establishes and maintains desired fresh food compartment and freezer compartment temperatures, as well as enabling various user selectable features.

2. Discussion of the Prior Art

In general, a refrigerator includes a first or freezer compartment for maintaining foodstuffs at or below freezing, and a second or fresh food compartment for maintaining foodstuffs in a temperature zone between ambient and freezing temperatures. A typical refrigerator includes a refrigeration system having a compressor, a condenser coil, a condenser fan, an evaporator, and an evaporator fan.

In operation, temperature sensors provided within the refrigerator are used to measure temperatures in the fresh food and freezer compartments. When a door associated with either compartment is opened, the resulting loss of cool air will cause the temperature of the compartment to rise. When the temperature of the compartment deviates from a predetermined or pre-selected temperature, the refrigeration system is activated to return the temperature to a point below a consumer or factory established set-point. In order to return the compartment temperature to this point, prior art systems are caused to operate at maximum capacity regardless of the degree of the deviation.

Prior art refrigerators typically employ a wide temperature zone or bounce region that establishes an acceptable temperature range in order to minimize operation of the refrigeration system. A small temperature zone or bounce region results in extended operation of the system, thereby reducing energy efficiency. On the other hand, a wide temperature zone causes temperature fluctuations that may negatively impact quality and/or taste of certain food items.

As part of the overall refrigeration system, a damper is typically provided between the freezer compartment and the fresh food compartment. Operation of the damper is controlled such that cool air is permitted to flow from the freezer compartment to the fresh food compartment. In some arrangements, a fan is mounted within a housing adjacent the evaporator to aid in establishing the airflow. Accordingly, if the temperature of the fresh food compartment rises above the set-point, the damper is opened to allow the passage of cooling air from the evaporator compartment into the fresh food compartment.

In addition, one or more fans have been incorporated into the fresh food compartment to circulate or evenly distribute the cooling air in order to minimize temperature stratification. Typically, the fan(s) is continuously operated when the fresh food door is closed. However, operating the fan when the damper is open may cause too much cooling air to be drawn into the fresh food compartment. In any event, in addition to controlling refrigeration components, dampers and fans, many refrigerators include controls that enable a consumer to selectively activate various features to tailor operation of the refrigerator to suit a particular need.

Regardless of the teachings in the prior art, there still exists a need for an enhanced refrigerator control system. More specifically, there exists a need for a refrigerator controller that combines operation of the damper and a fan in the fresh food compartment to maintain desired compartment temperatures. In addition, there exists a need for a controller that can determine a direction and magnitude of change of temperature in the fresh food and/or freezer compartments to provide greater sensitivity in order to minimize activation of the refrigeration system, as well as blend various user selectable features to obtain a synergistic combination that appeals to consumers.

SUMMARY OF THE INVENTION

The present invention is directed to a refrigerator including an outer shell or cabinet within which is defined a fresh food compartment and a freezer compartment. In a manner known in the art, the refrigerator includes a pair of doors pivotally mounted to the cabinet to selectively access the fresh food and freezer compartments. In a manner also known in the art, the refrigerator includes a refrigeration system for regulating temperatures in the fresh food and freezer compartments. A duct is provided to fluidly interconnect the freezer compartment and the fresh food compartment. Arranged along the duct is a damper which selectively shifts between an open position, wherein cool air flows into the fresh food compartment, to a closed position depending upon a sensed need for cooling in the fresh food compartment.

In accordance with the invention, an air mixing fan is arranged in the fresh food compartment. The air mixing fan is selectively activated to establish a cooling airflow in the fresh food compartment to eliminate, or at least minimize, temperature stratification. The refrigerator further includes an ice maker, a user interface having a plurality of control elements and a controller operatively associated with the user interface. The controller includes a memory having stored therein a plurality of operating parameters for controlling various aspects or features of the refrigerator.

In accordance with a preferred form of the invention, the operating parameters include a temperature control mode, a super cool mode, a food saver mode and a quick ice mode. The temperature control mode is employed to establish and maintain temperatures in the fresh food and freezer compartments. More specifically, the temperature control mode monitors for temperature trends. That is, if a magnitude and direction of a temperature of the freezer compartment indicates a warming trend, the refrigeration system is activated. Conversely, a cooling trend causes the refrigeration system to turn off. The temperature of the fresh food compartment is also monitored and controlled in a similar manner. That is, if in a warming trend, the damper is opened, allowing cool air into the fresh food compartment. If in a cooling trend, the damper is closed.

The super cool mode is designed to lower a temperature of the fresh food compartment to overcome a temperature stratification effect caused by, for example, periodic door openings or the addition of a large, warm load. More specifically, repeatedly opening the door and releasing cooler air or placing a large item that is at, near or above room temperature into the fresh food compartment can create a temperature stratification effect in the fresh food compartment and may even raise the temperature of the fresh food compartment above selected levels. In order to proactively address the potential sudden increase in temperature, a consumer can selectively activate the super cool mode wherein the cooling trend in the fresh food compartment is adjusted to compensate for loss of cool air or the added heat, preferably by activating the mixing fan at full power if the damper is closed. If the damper is open, the air mixing fan is not active. In this manner, the temperature of the fresh food compartment can be normalized without exceeding any pre-set compartment temperature.

A consumer can rapidly lower temperatures in both the fresh food and freezer compartments by activating the food saver mode. When in the food saver mode, the controller automatically lowers the temperature of each of the fresh food and freezer compartments to a minimum setting for a predetermined period of time. Finally, if the consumer wishes to shorten ice production time, the quick ice mode is activated. When operating in the quick ice mode, the controller automatically lowers the temperature of the freezer compartment to a minimum setting for a first predetermined time period and, in one preferred embodiment, each time the ice maker is filled with water, activates the evaporator fan for a second predetermined time period.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1A:
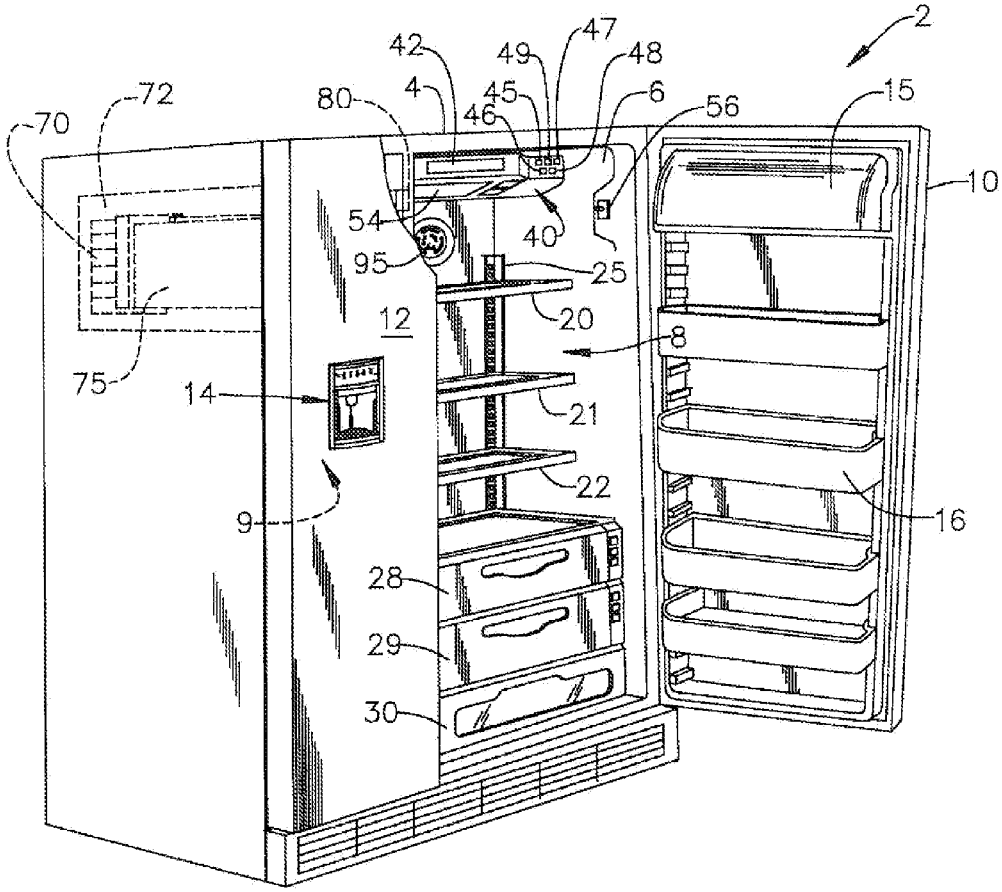
FIG. 1A is a perspective view of a refrigerator including a control constructed in accordance with the present invention.
Figure 1B:
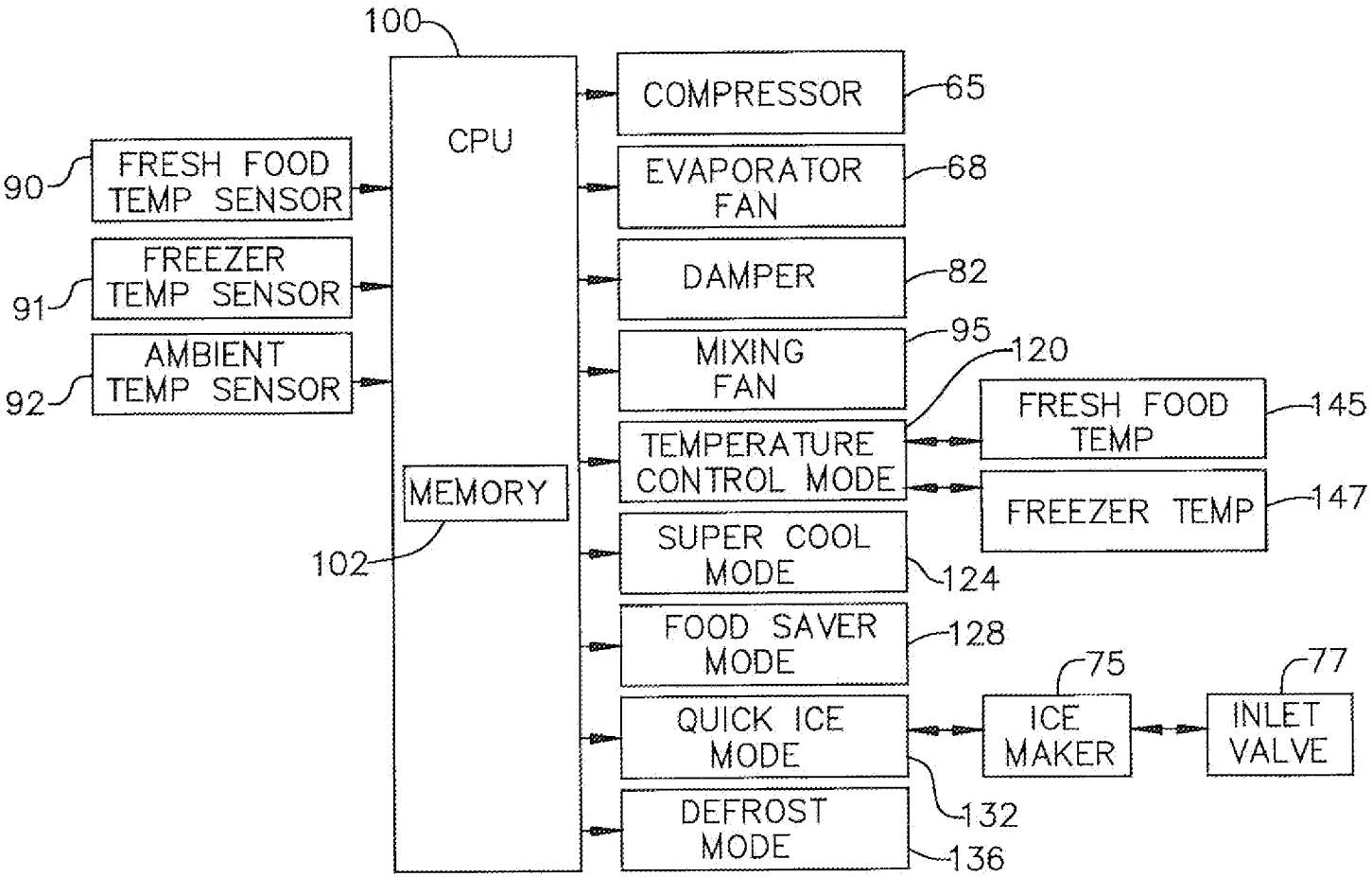
FIG. 1B is a block diagram of the control constructed in accordance with the present invention.

With initial reference to FIGS. 1A and 1B, a refrigerator 2 includes an outer shell or cabinet 4 within which is positioned a liner 6 that defines a fresh food compartment 8. Another liner (not shown) is also positioned in cabinet 4 to define a freezer compartment 9. In a manner known in the art, fresh food compartment 8 can be accessed by the selective opening of a fresh food door 10. In a similar manner, a freezer door 12 can be opened to access freezer compartment 9. In the embodiment shown, freezer door 12 includes a dispenser 14 that enables a consumer to retrieve ice and/or fresh water without opening either fresh food door 10 or freezer door 12. For the sake of completeness, door 10 of refrigerator 2 is shown to include a dairy compartment 15 and various vertically adjustable shelving units, one of which is indicated at 16.

In a manner known in the art, fresh food compartment 8 is provided with a plurality of vertically height adjustable shelves 20-22 supported by a pair of shelf support rails, one of which is indicated at 25. At a lowermost portion of fresh food compartment 8 is illustrated a pair of temperature controlled bins 28 and 29, as well as a conventional storage compartment 30. At an upper region of fresh food compartment 8 is a temperature control housing or user interface 40. In the embodiment shown, user interface 40 includes a display zone 42 and a plurality of control elements 45-49. Control elements 45-48 are constituted by temperature control elements for adjusting a temperature of fresh food compartment 8 and freezer compartment 9, while control element 49 is constituted by an auxiliary control element for re-setting, for example, a door alarm. For the sake of completeness, interface 40 is shown to include a light 54 which, in a manner known in the art, is controlled by a switch 56 operated by opening and closing door 10.

With further reference to FIG. 1B, refrigerator 2 includes a refrigeration system including at least a compressor 65, an evaporator (not shown) and an evaporator fan 68. Evaporator fan 68 establishes a cooling airflow that is delivered into at least freezer compartment 9. A first portion of a cooling airflow is directed through openings 70 (see FIG. 1), located in an evaporation fan cover 72, into freezer compartment 9. Actually, a first portion of the cooling airflow exits openings 70 and preferably, directly impinges upon an ice maker 75 which has associated therewith a water inlet, control valve 77 (see FIG. 1B). By directing the cool air directly onto ice maker 75, the production and quality of ice is enhanced. A second portion of the cooling airflow passes through a duct 80 which leads into fresh food compartment 8. Actually, as the evaporator (not shown) is open to freezer compartment 9 via cover 72, fresh food compartment 8 is cooled by cooling air that flows from freezer compartment 9.

In order to regulate the flow of cooling air into fresh food compartment 8, a damper 82 is arranged within duct 80. More specifically, based on a cooling demand as sensed by, for example, a fresh food compartment temperature sensor 90, damper 82 shifts between a closed position and an open position. That is, in response to a sensed need for cooling, damper 82 opens to allow cool air to flow into fresh food compartment 8. In accordance with one aspect of the invention, the degree of opening of damper 82 depends upon a particular cooling requirement. More specifically, the greater the need for cooling, the greater the shift to the open position. In a similar manner, if there is a need for cooling freezer compartment 9 as sensed by, for example, a freezer temperature sensor 91, evaporator fan 68 is activated. Input is also received from an ambient sensor 92 to further enhance temperature regulation. Additional temperature regulation is provided for fresh food compartment 8 with the incorporation of an air mixing fan 95. When activated, air mixing fan 95 circulates cooling air in fresh food compartment 8 in order to eliminate, or at least substantially reduce, temperature stratification.

In accordance with the invention, refrigerator 2 includes a CPU or controller 100 having a memory 102. Controller 100 regulates operation of refrigerator 2 based upon factory settings and/or selected user preferences. User preferences may include setting preferred temperatures for fresh food compartment 8 and freezer compartment 9, as well as various model dependent, special features incorporated into refrigerator 2. That is, each model refrigerator may include one or more available special features that could be activated through user interface 40. Toward that end, stored in memory 102 are various operating parameters for refrigerator 2. In accordance with the embodiment shown, the operating parameters include: a temperature control mode 120, a super cool mode 124, a food saver mode 128, a quick ice mode 132 and a defrost mode 136. In addition, CPU 100 controls operation of temperature control bins 28 and 29, as well as numerous other features which do not form part of the present invention.

In accordance with a preferred form of the invention, temperature mode 120 includes at least two sub-routines. That is, temperature mode 120 includes a fresh food sub-routine that monitors a magnitude and direction of a temperature in fresh food compartment 8 to establish and maintain a temperature within fresh food compartment 8 and a freezer sub-routine that monitors a magnitude and direction in freezer compartment 9 to establish and maintain a temperature in freezer compartment 9. Thus, by monitoring both magnitude and direction of temperatures, temperature mode 120 monitors trends in temperature which are employed to maintain fresh food and freezer compartments 8, 9 temperatures at a desired setting as will be discussed more fully below.

Figure 2:
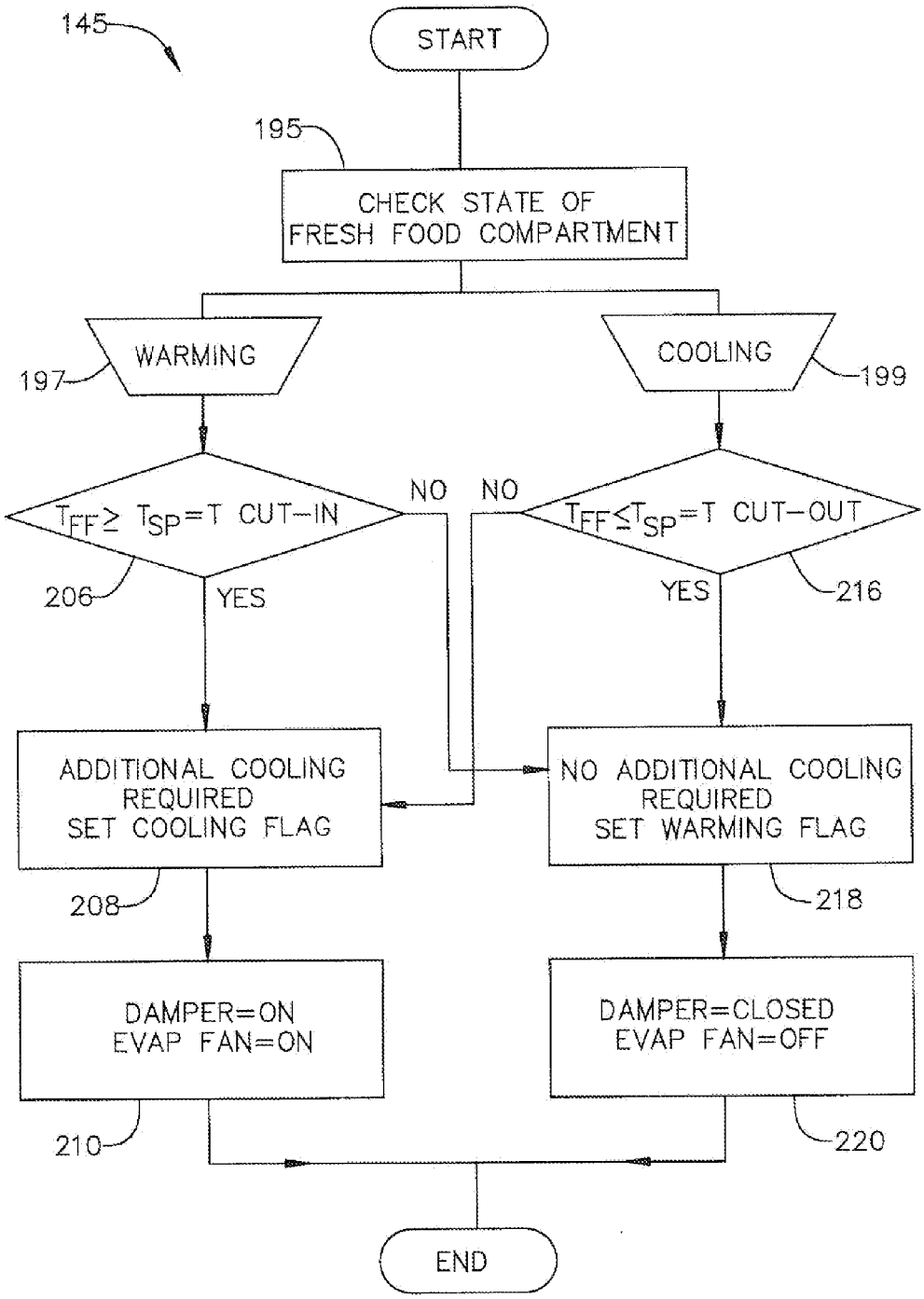
FIG. 2 is a flow chart illustrating a temperature control mode for a fresh food compartment of the refrigerator of FIG. 1.

Referring to FIG. 2, fresh food sub-routine 145 starts by checking a current state of fresh food compartment 8 in step 195. That is, as will be discussed more fully below, fresh food sub-routine 145 determines whether the temperature in fresh food compartment 8 is rising, thus indicating a warming trend, or whether the temperature in fresh food compartment 8 is lowering, thus indicating a cooling trend. If warming, or more specifically if a warming flag has been set, fresh food sub-routine 145 moves to a warming mode in step 197. If cooling, fresh food sub-routine 145 moves to a cooling mode 199.

In warming mode or routine 197, controller 100 determines whether the temperature of fresh food compartment 8 ($T_{FF}$) is greater than or equal to a set point temperature ($T_{SP}$) plus a cut-in temperature ($T_{cut\text{-}in}$). That is, controller 100 determines whether the temperature in fresh food compartment 8 is above a consumer or factory established set point ($T_{SP}$) plus the cut-in temperature ($T_{cut\text{-}in}$) value for compressor 65. If the temperature is greater or equal to this value, additional cooling is deemed necessary and a cooling flag is set in step 208. Once a cooling flag is set, controller 100 opens damper 82 and activates evaporator fan 68 in order to begin to pull down or lower the temperature of fresh food compartment 8 to the desired level.

Obviously, if in step 195, a cooling flag is active, fresh food sub-routine 145 moves to cooling mode step 199. At this point, controller 100 determines whether the temperature of fresh food compartment 8 is less than or equal to the set point temperature ($T_{SP}$) less a temperature cut-out ($T_{cut\text{-}out}$) value for compressor 65 in step 216. That is, if the temperature of fresh food compartment 8 is less than or equal to the established set point temperature ($T_{SP}$) less a cut-out value ($T_{cut\text{-}out}$) for compressor 65, no additional cooling is required and a warming flag is set in step 218. Once warming flag is set in step 218, damper 82 is closed and evaporator fan 68 is deactivated in step 220.

If in step 206 it is determined that the temperature of fresh food compartment 8 is less than the set point temperature ($T_{SP}$) plus the cut-in temperature ($T_{cut\text{-}in}$), warming mode step 197 shifts to step 218 in cooling mode step 199 and a warming flag is set ensuring that damper 82 is closed and evaporator fan 68 is deactivated. Likewise, if in cooling mode 199, controller 100 determines that the temperature of fresh food compartment 8 is greater than or equal to the set point temperature ($T_{SP}$) minus the cut out value ($T_{cut\text{-}out}$) in step 216, cooling mode step 199 shifts to step 208 in warming mode 197, a cooling flag is set, damper 82 is opened and evaporator fan 68 is activated.

Figure 3:
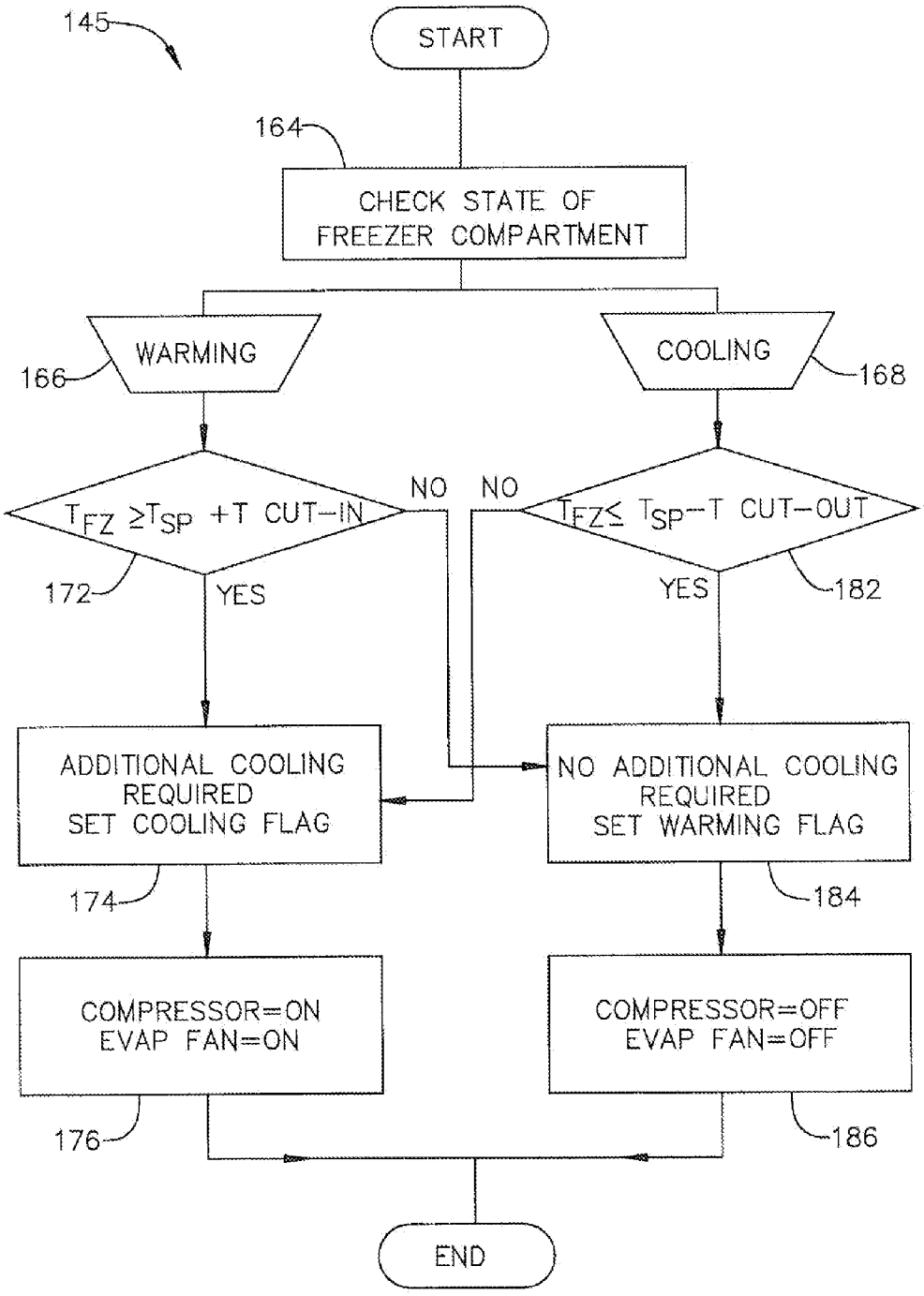
FIG. 3 is a flow chart illustrating a temperature control mode for a freezer compartment of the refrigerator of FIG. 1.

Reference will now be made to FIG. 3 in describing the steps associated with freezer temperature sub-routine 147. In a manner similar to that described above, controller 100 initially determines a status of freezer compartment 9 to sense whether the temperature in freezer compartment 9 is rising, indicating a warming trend, or lowering, indicating a cooling trend. If warming, freezer temperature sub-routine 147 shifts to warming routine mode step 166 and, if cooling, freezer temperature sub-routine shifts to cooling mode step 168.

In the warming mode step 166, controller 100 determines whether the temperature of freezer compartment ($T_{FZ}$) 9 is greater than the set point temperature ($T_{SP}$) plus the cut-in temperature ($T_{cut\text{-}in}$) in step 172. At this point, it should be understood that the $T_{SP}$ and $T_{cut\text{-}in}$ values for freezer compartment 9 differ from those used for fresh food compartment 8. In any case, if the temperature in freezer compartment 9 ($T_{FZ}$) is greater than the set point temperature ($T_{SP}$) plus the cut-in temperature ($T_{cut\text{-}in}$), additional cooling is required and a cooling flag is set in step 174. At this point, compressor 65 and evaporator fan 68 are activated in step 176 to bring down or lower the temperature in freezer compartment 9.

If it is established in step 164 that the temperature in freezer compartment 9 is cooling, freezer temperature sub-routine 147 moves to cooling mode in step 168. Once in the cooling mode step 168, controller 100 determines whether the temperature in freezer compartment 9 is less than or equal to the temperature set point ($T_{SP}$) less the cut-out temperature ($T_{cut\text{-}out}$) in step 182. If the temperature of freezer compartment 9 is less than or equal to the set-point temperature minus the cut-out temperature for compressor 65, no additional cooling is required and a warming flag is set in step 184. At this point, compressor 65 and evaporator fan 68 are deactivated in step 186.

In a manner similar to that described above, if in step 172 controller 100 determines that the temperature of freezer compartment 9 ($T_{FZ}$) is greater than $T_{SP}+_{CUT\text{-}IN}$, freezer temperature sub-routine 147 shifts to step 184 of the cooling mode. Likewise, if in step 182 it is determined that the temperature of freezer compartment 9 ($T_{FZ}$) is greater than $T_{SP}-T_{CUT\text{-}IN}$, freezer temperature sub-routine 147 shifts to step 174 of the warming mode followed by the activation of compressor 65 and evaporator fan 68 in step 176.

Figure 4:
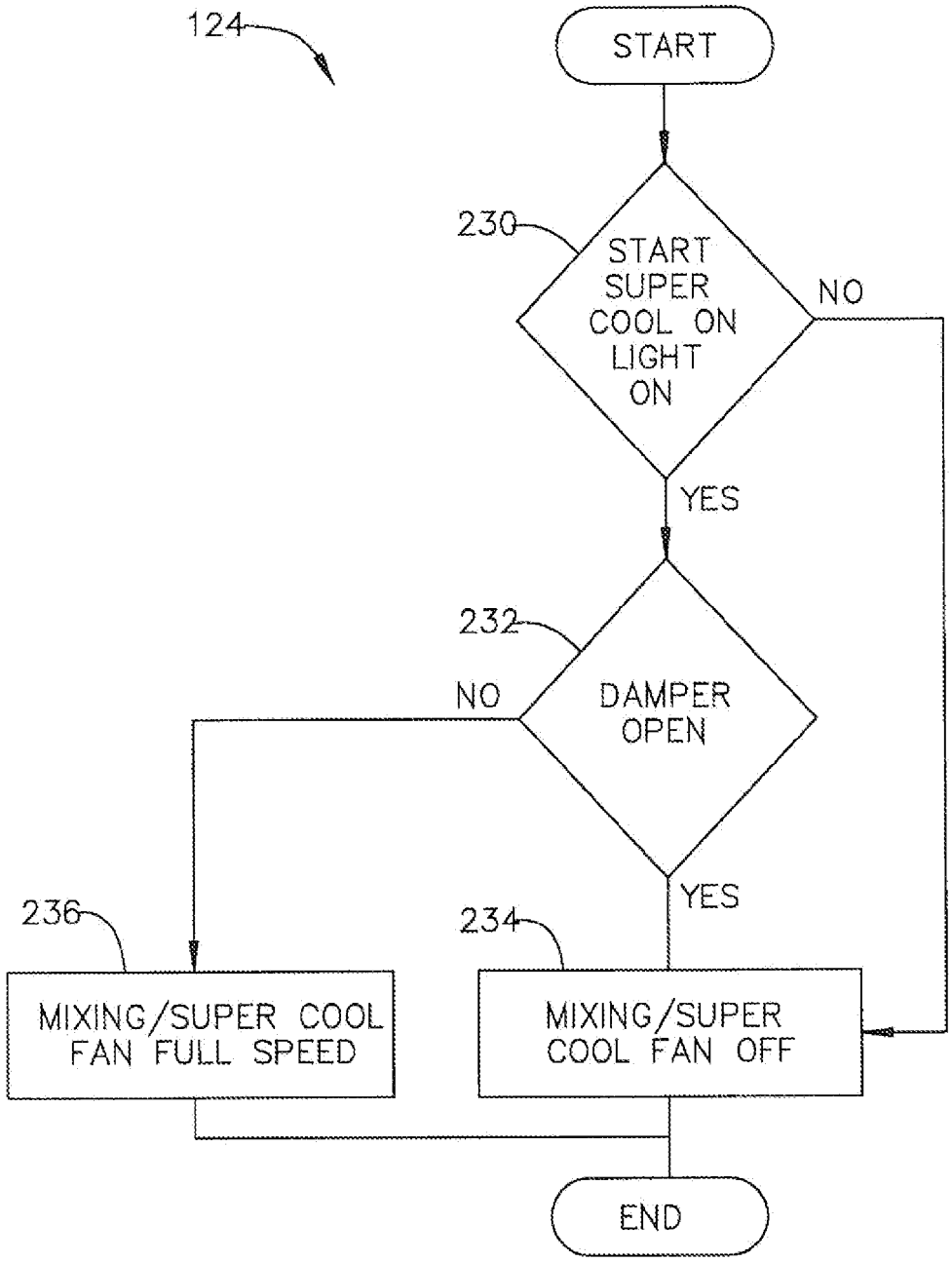
FIG. 4 is a flow chart illustrating a super cool mode for the refrigerator of FIG. 1.

Reference will now be made to FIG. 4 in describing the steps performed in super cool mode 124. As shown, super cool mode 124 is initiated by making an appropriate selection through user interface 40. Thus, controller 100 initially determines whether or not super cool mode 124 has been selected in step 230. If super cool mode 124 is selected, an indicator light (not shown) on user interface 40 is preferably activated. At this point, controller 100 determines a position of damper 82 in step 232. If damper 82 is at least partially open, mixing or super cool fan 95 is deactivated in step 234. On the other hand, if damper 82 is closed, super cool fan 85 is operated at full speed in step 236. Thus, in accordance with the most preferred form of the invention, when operating in super cool mode 124, the operation of mixing/super cool fan 85 is tied to the position of damper 82. More specifically, the operation of mixing/super cool fan 85 will be tied directly to the position of damper 232 until such time as super cool mode 124 has been deactivated. In this manner, temperature stratification in fresh food compartment 8 can be minimized without drawing excessive amounts of cooling air from freezer compartment 9.

Figure 5:
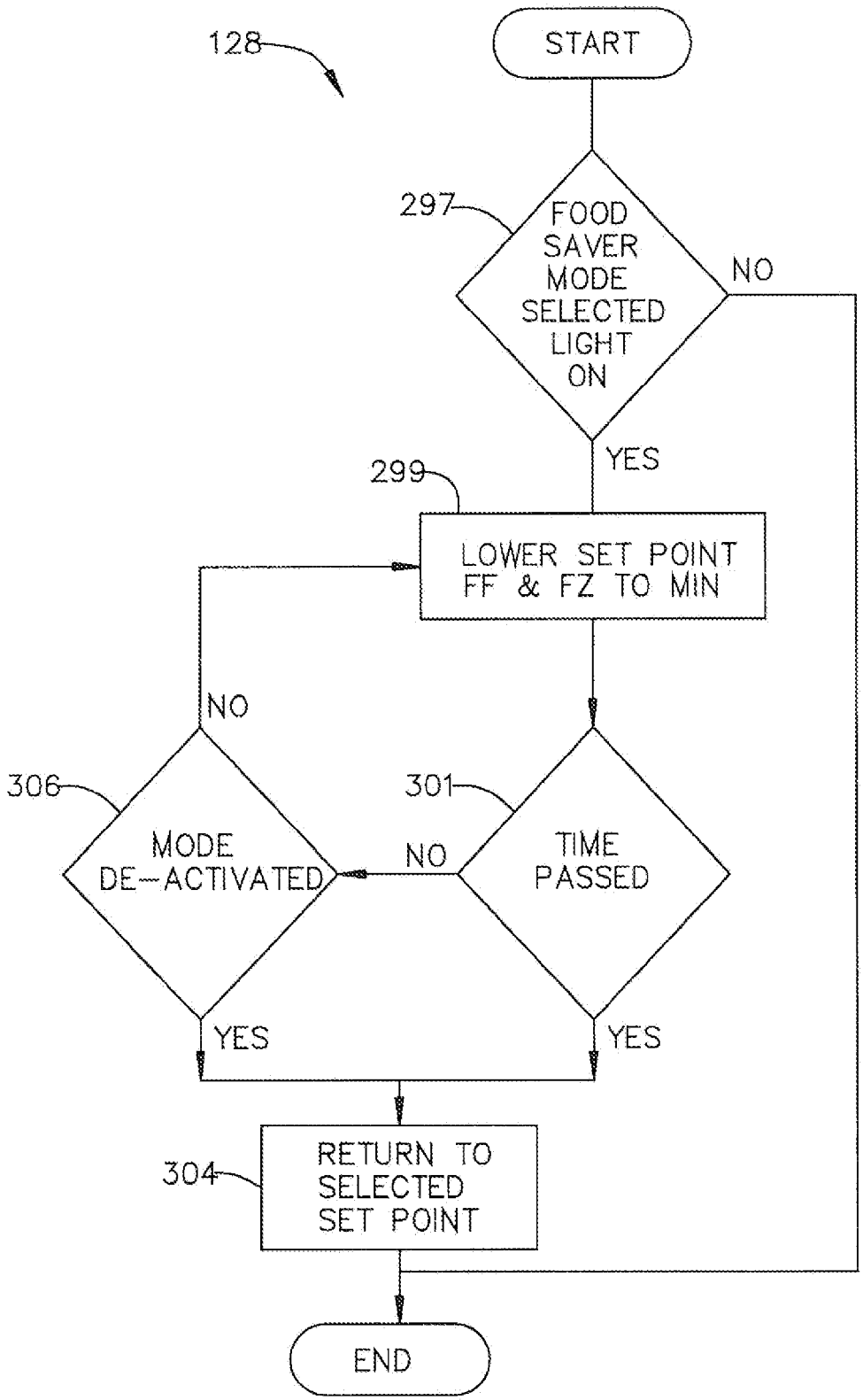
FIG. 5 is a flow chart illustrating a food saver mode for the refrigerator of FIG. 1.

Reference will now be made to FIG. 5 in describing the operation of food saver mode 128. In a manner similar to that described above, food saver mode 128 is initiated through selection of one of control elements 45-49 on user interface 40. Thus, an initial determination is made in step 297 to check whether food saver mode 128 has been activated and, if so, an associated indicator light (not shown) is illuminated. At this point, controller 100 lowers temperature set points for both fresh food compartment 8 and freezer compartment 9 to minimum levels in step 299. In accordance with the most preferred form of the invention, unless manually deactivated, food saver mode 128 operates for a predetermined period of time, for example, twelve hours. Therefore, in step 301 controller 100 determines whether the predetermined time has elapsed. If the time has elapsed, set point temperatures for fresh food compartment 8 and freezer compartment 9 are returned to pre-selected or factory levels in step 304. If the predetermined time has not elapsed, a determination is made whether food saver mode 128 has been manually deactivated in step 306. If deactivated, then food saver mode 128 returns the temperatures of fresh food compartment 8 and freezer compartment 9 to the original set points. Otherwise, food saver mode 128 continues until step 301 yields a positive value, i.e., the predetermined time period has lapsed.

Figure 6:
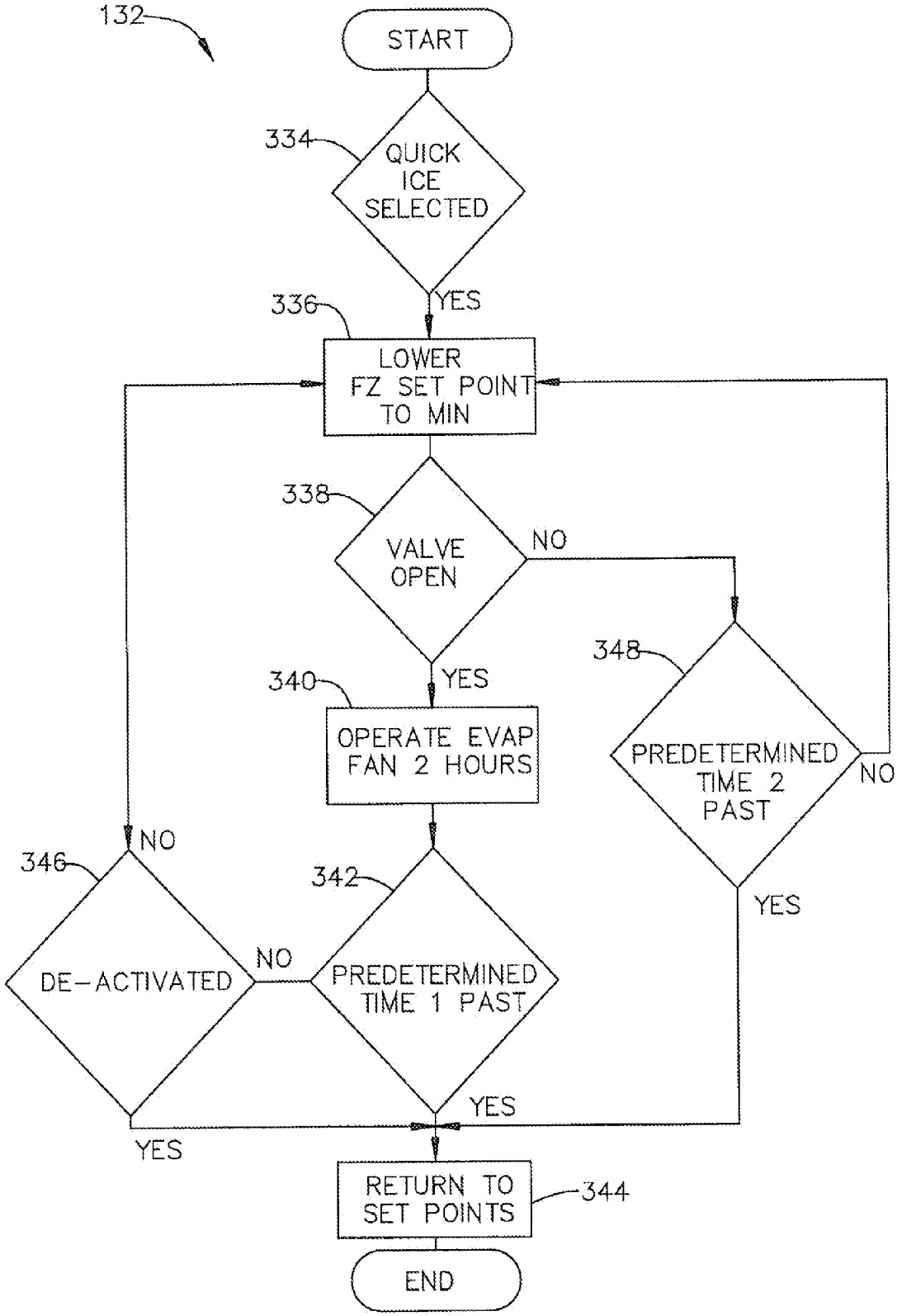
FIG. 6 is a flow chart illustrating a quick ice mode for the refrigerator of FIG. 1.

Next, your attention is directed to FIG. 6 which illustrates the operation of quick ice mode 132. In a manner again similar to that described above, quick ice mode 132 is initiated through selection of control elements 45-49 on user interface 40. Thus, an initial determination is made whether a consumer has activated quick ice mode 132 in step 334. If quick ice mode 132 has been activated, controller 100 lowers a set point temperature of freezer compartment 9 in step 336. At this point, controller 100 monitors operation of valve 77 in ice maker 75 in step 338. If valve 77 is opened, controller 100 activates evaporator fan 68 for a predetermined time period, e.g., two hours in step 340. That is, regardless of the need for cooling in freezer compartment 9, controller 100 will operate evaporator fan 68 for the predetermined time period.

In accordance with the invention, once selected, quick ice mode 132 remains active for a predetermined period of time, for example, 48 hours or until manually shut-off. Thus, in step 342 a determination is made as to whether the predetermined time has elapsed. If the predetermined time has elapsed, controller 100 returns a set point temperature for freezer compartment 9 to a preset level in step 334 and thereafter terminates. Alternatively, if the predetermined time period has not passed, controller 100 checks whether quick ice mode 132 has been manually deactivated in step 346. If so, quick ice mode 132 moves to step 344 and thereafter terminates. If, however, quick ice mode 132 has not been deactivated in step 346, the temperature of freezer compartment 9 will remain at the reduced or minimum set point and the operation of valve 77 continues to be monitored.

In an alternative arrangement, quick ice mode 132 can be automatically deactivated if valve 77 has not opened for a predetermined period of time. That is, if after a predetermined period of time, for example 12 hours, valve 77 does not open to refill ice maker 75, there is no longer deemed a need for continued ice production. More specifically, if in step 338 valve 77 has not opened for a second predetermined period of time, quick ice mode 132 moves to step 345 to determine whether the second predetermined time has elapsed. If so, quick ice mode 132 moves to step 344 returning the set point of freezer compartment 9 to a normal or pre-established level and thereafter terminates.

For the sake of completeness, controller 100 can initiate a defrost mode 136. For use with the invention, the defrost mode can operate on an adaptive and/or pre-emptive basis when a determination is made that the evaporator (not shown) requires de-icing. In accordance with one embodiment, defrost mode 136 senses door openings of refrigerator 2 to determine periods of low or little usage. The periods of low or little usage are grouped into blocks which correspond to various time periods of a day. Preferably, controller 100 will not activate defrost mode 136 in a high usage block and, most preferably, activates defrost mode 136 in a low, preferably the lowest, usage block.

In any event, with the above arrangement, it is possible to operate refrigerator 2 in a manner which enhances control of fresh food compartment 8 and freezer compartment 9. More specifically, the various operating modes outlined above can be selected individually or synergistically combined to efficiently operate refrigerator 2. Depending on a consumer's particular needs, he/she can simply access interface 40 to select or adjust various operating parameters of refrigerator 2 including the activation/deactivation of the various modes as set forth in accordance with the invention.

Although described with reference to a preferred embodiment of the invention, it should be readily understood that various changes and/or modifications can be made to the invention without departing from the spirit thereof. For instance, while the user interface is illustrated at an upper portion of the fresh food compartment, other locations, such as on one of doors 10 and/or 12, would also be acceptable. In general, the invention is only intended to be limited by the scope of the following claims.

We claim:

1. A method of controlling a refrigerator including fresh food and freezer compartments, a damper controlled air passage communicating the fresh food compartment with the freezer compartment and an air mixing fan in the fresh food compartment comprising:

activating the air mixing fan at full power if the damper is closed; and maintaining the air mixing fan off if the damper is open.

2. The method of claim 1, further comprising:

activating the air mixing fan at a predetermined speed to establish a recirculating airflow within the flesh food compartment; and reducing the speed of the air mixing fan upon opening of a fresh food compartment door.

3. A method of controlling a refrigerator including fresh food and freezer compartments, as well as an evaporator fan and an ice maker, comprising:

opening a valve to deliver water to the ice maker;

controlling the evaporator fan based, at least in part, on opening of the valve;

operating the refrigerator in a quick ice mode; and automatically deactivating the quick ice mode when the valve has not been opened for a predetermined period of time.

4. The method of claim 3, further comprising:

re-activating the quick ice mode if the valve has been opened prior to expiration of the predetermined time.

5. The method of claim 3, further comprising:

automatically lowering a temperature in the freezer compartment to a minimum setting for a predetermined time period upon activation of the quick ice mode.

6. In a refrigerator including: a cabinet within which is defined a fresh food compartment and a freezer compartment; a door pivotally mounted relative to the cabinet, said door being adapted to selectively close at least one of the fresh food and freezer compartments; an evaporator arranged in the cabinet, said evaporator including an evaporator fan; a duct leading from the freezer compartment to the fresh food compartment; a damper pivotally mounted in the duct, said damper being selectively shiftable between an open position, wherein the fresh food compartment is fluidly connected to the freezer compartment, to a closed position, wherein the fresh food compartment is substantially isolated from the freezer compartment; an air mixing fan arranged in the fresh food compartment; a user interface including a plurality of control elements for selectively adjusting operating parameters of the refrigerator; and a controller operatively coupled to the user interface, said controller including a memory having stored therein a plurality of operating parameters including a super cool mode for adjusting the fresh food compartment temperature to prevent stratification, a method of controlling the refrigerator comprising: when the super cool mode is active, activating the air mixing fan at full power to establish a recirculating airflow within the fresh food compartment if the damper is closed and maintaining the air mixing fan off if the damper is open.

7. The method of claim 6, further comprising: operating the refrigerator in a quick ice mode for rapidly forming ice in an ice maker provided in the freezer compartment by automatically lowering the freezer compartment temperature to a minimum setting for a first predetermined time period and, each time the ice maker is filled with water, activating the evaporator fan for a second predetermined time period.

8. The method of claim 6, further comprising: selectively activating the air mixing fan at a predetermined speed to establish the recirculating airflow within the fresh food compartment, and reducing the speed of the air mixing fan upon opening of the door.

9. In a refrigerator including: a cabinet within which is defined a fresh food compartment and a freezer compartment; a door pivotally mounted relative to the cabinet, said door being adapted to selectively close at least one of the fresh food and freezer compartments; an evaporator arranged in the cabinet, said evaporator including an evaporator fan; a duct leading from the freezer compartment to the fresh food compartment; an ice maker provided in the freezer compartment for selectively producing ice; a user interface including a plurality of control elements for selectively adjusting operating parameters of the refrigerator; a controller operatively coupled to the user interface, said controller including a memory having stored therein a plurality of operating parameters including a quick ice mode for rapidly forming ice in the ice maker; and a valve for use in filling the ice maker with water, a method of controlling the refrigerator comprising: when in the quick ice mode, activating the evaporator fan each time the valve is operated to fill the ice maker with water; and automatically deactivating the quick ice mode if the valve has not been opened for a predetermined period of time.

10. The method of claim 9, further comprising: selectively, manually controlling the quick ice mode through the user interface.

11. The method of claim 9, further comprising: automatically establishing a minimum freezer compartment temperature setting for a first predetermined time period upon activation of the quick ice mode.

* * * * *

UNITED STATES PATENT AND TRADEMARK OFFICE

CERTIFICATE OF CORRECTION

PATENT NO. : 8,037,701 B2
APPLICATION NO. : 12/820173
DATED : October 18, 2011
INVENTOR(S) : Thomas Carl Anell et al.

It is certified that error appears in the above-identified patent and that said Letters Patent is hereby corrected as shown below:

Col. 8, lines 29 - 34, Claim 2: "The method of claim 1, further comprising: activating the air mixing fan at a predetermined speed to establish a recirculating airflow within the flesh food compartment; and reducing the speed of the air mixing fan upon opening of a fresh food compartment door." should be Claim 2: -- The method of claim 1, further comprising: activating the air mixing fan at a predetermined speed to establish a recirculating airflow within the fresh food compartment; and reducing the speed of the air mixing fan upon opening of a fresh food compartment door. --

Signed and Sealed this
Twenty-eighth Day of August, 2012

David J. Kappos

David J. Kappos
*Director of the United States Patent and Trademark Office*